United States Patent [19]

Koford et al.

[11] 4,385,793

[45] May 31, 1983

[54] MEDICAL TERMINAL CLIP WITH ANTI-TANGLE DEVICE

[75] Inventors: Stuart K. Koford, Bartlett; John C. Colwell, Hoffman Estates, both of Ill.; Alexander D. Simon, Van Nuys, Calif.

[73] Assignee: Allied Corporation, Morris Township, Morris County, N.J.

[21] Appl. No.: 262,666

[22] Filed: May 11, 1981

[51] Int. Cl.[3] ..... H01R 11/22

[52] U.S. Cl. ..... 339/61 R; 339/101; 339/261

[58] Field of Search ..... 339/61 R, 61 M, 101, 339/103 R, 103 B, 103 M, 200 P, 255 P, 260, 261

[56] References Cited

U.S. PATENT DOCUMENTS

| | | | |
|---|---|---|---|
| D. 251,387 | 3/1979 | Ramsay et al. . | |
| 1,698,379 | 1/1929 | Taylor | 339/261 |
| 1,797,467 | 3/1931 | Dusinberre | 339/261 |
| 2,036,461 | 4/1936 | Darby | 132/36.2 R |
| 2,103,891 | 12/1937 | Brown | 339/255 X |
| 3,183,469 | 5/1965 | Trachtenberg | 339/255 P |
| 3,234,497 | 2/1966 | Condry | 339/110 R |
| 3,624,590 | 11/1971 | Bolduc | 339/255 P |
| 4,040,697 | 8/1977 | Ramsay et al. | 339/61 R |
| 4,072,388 | 2/1978 | Dunn | 339/103 R |
| 4,162,817 | 7/1979 | Briggs et al. | 339/75 MP |
| 4,178,052 | 12/1979 | Ekbom et al. | 339/61 R |

*Primary Examiner*—Joseph H. McGlynn
*Attorney, Agent, or Firm*—Roger H. Criss

[57] ABSTRACT

An electrical connector in the form of a medical terminal clip for use with instruments such as medical monitoring instruments, or the like, and which includes an anti-tangle device releasably locked to the free ends of the terminal clip arms.

11 Claims, 4 Drawing Figures

MEDICAL TERMINAL CLIP WITH ANTI-TANGLE DEVICE

BACKGROUND OF THE INVENTION

This invention relates generally to an electrical connector for engaging an electrode and, more particularly, to a medical terminal clip for use with instruments such as medical monitoring instruments, or the like.

Electrical connectors are known for making connections between anatomical body electrodes of conventional types and an electrical monitoring machine such as an electrocardiograph machine. Such connectors are often in the form of a terminal clip which includes a terminal body member having a pair of generally side-by-side arms movable toward and away from each other. Each arm has one end fixed to electrical contact means for engaging a body electrode. The contact means often is embedded within the terminal body member which may be integrally molded of plastic material. A lead wire is terminated to the contact means, usually within the terminal body member, and extends from the free end of one of the movable arms to the electrocardiograph. A plurality of electrodes, and a resulting plurality of terminal clips, are used in certain medical analysis and are applied to common anatomical positions such as the arms, legs and particular torso areas of a patient.

One of the problems with terminal clips and lead wires of the character described is that the clips and wires tend to become tangled with each other. This is often due to the projection of the free end of the clip arm which does not contain the lead wire. The entanglement of the clips and wires may cause breaks in the electrical connections and also makes attachment and detachment of the clips with the electrodes difficult.

Some prior attempts to solve the entanglement problem are shown in U.S. Pat. Nos. 4,040,697 and 4,178,052 wherein anti-tangle webs are molded integrally with and extend between the clip arms generally at the free ends thereof. Another solution is shown in U.S. Pat. No. 4,072,388 wherein an anti-snag device is shown in the form of an elongated tube having one end slid over the free end of one clip arm and the other end engaging the lead wire at a point removed from the free end of the other arm.

The present invention is directed to providing a terminal clip of the character described with an anti-tangle device which is inexpensive, reliable and provides bend relief for the lead wire extending from the clip to a monitoring instrument or machine.

SUMMARY OF THE INVENTION

It is therefore an object of the present invention to provide a new and improved electrical connector in the form of a medical terminal clip for use with medical monitoring electrodes and instruments, and which includes a novel anti-tangle device.

In accordance with these and other objects and advantages of the present invention which will become apparent upon reading the following detailed description, the present invention comprises a terminal body member having first and second generally side-by-side arms movable toward and away from each other for opening and closing the clip. The body member is an integrally molded structure having electrical contact means for engaging an electrode. Each arm has one end fixed to the electrical contact means. The first arm has a lead wire embedded therein and extending from the free end thereof to the medical monitoring instrument.

The anti-tangle device of the present invention comprises an elongated, flexible portion extending between the free ends of the arms and of sufficient length to permit toward end away movement of the arms. Complementary engaging means is provided between the free ends of the arms and the opposite ends of the flexible portion for releasably locking the anti-tangle device to the arms.

In the exemplary embodiment of the invention, the flexible portion and the complementary engaging means of the anti-tangle device comprise an integrally molded structure. The complementary engaging means on the free end of the second arm comprises a button, and the complementary engaging means on one end of the flexible portion of the anti-tangle device comprises a cap snap-fit over the button.

Another feature of the invention comprises a boot forming the complementary engaging means on the opposite end of the flexible portion of the anti-tangle device for locking onto the free end of the first arm. The boot surrounds the lead wire to provide bend relief means for the wire.

BRIEF DESCRIPTION OF THE DRAWINGS

The features of this invention which are believed to be novel and unobvious are set forth with particularity in the appended claims. The invention, together with its objects and advantages, may be best understood by reference to the following description taken in conjunction with the accompanying drawings in which like reference numerals identify like elements in the several figures and in which:

DESCRIPTION OF THE PREFERRED EMBODIMENT

Figure 1:
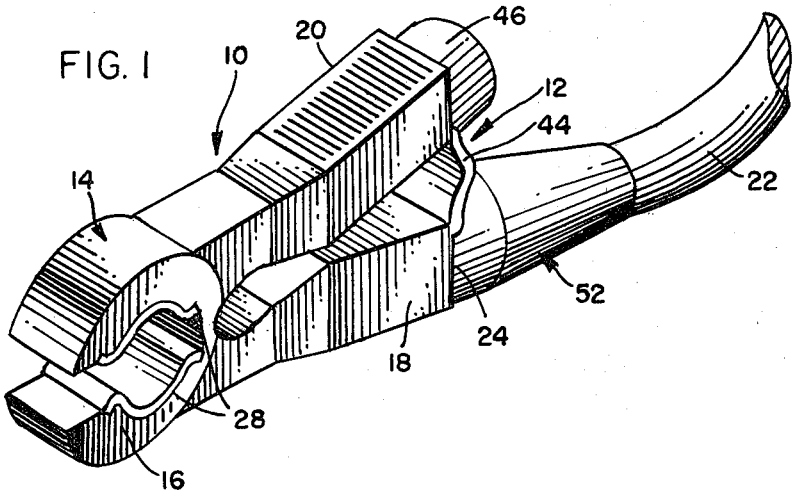
FIG. 1 is a perspective view illustrating a preferred embodiment of the medical clip and anti-tangle device of the present invention as seen from a foreward vantage point.

Referring to the drawings in greater detail, and first to FIG. 1, the electrical connector of the present invention is shown in the form of a medical terminal clip, generally designated 10, and includes an anti-tangle device, generally designated 12. The terminal clip is integrally molded of dielectric plastic material and includes a pair of foreward jaws 14 and 16. First and second arms 18 and 20 are disposed generally side-by-side and extend rearwardly from the jaws. The arms are movable toward and away from each other for opening and closing the clip. First arm 18 has a lead wire 22 extending from a free end 24 thereof to a medical monitoring instrument or machine (not shown).

Figure 2:
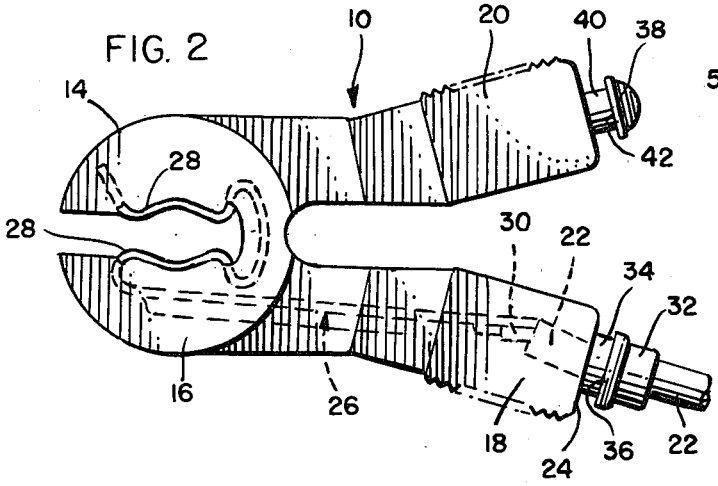
FIG. 2 is a top plan view of the terminal clip shown in FIG. 1.

Referring to FIG. 2, electrical contact means, generally designated 26, is embedded within first arm 18 and jaws 14 and 16. The contact means has opposed, facing portions 28 exposed between jaws 14 and 16 for engaging a conventional medical electrode (not shown) attached to a body member of a patient. The contact means also has crimp means 30 for termination with the conductor of lead wire 22.

In order to releasably lock anti-tangle device 12 to and between the free ends of arms 18 and 20, complementary engaging means is provided protruding rearwardly from the rear ends of the arms. More particularly, and referring again to FIG. 2, first arm 18 has a generally rectangular boss including a head portion 32 and a stub portion 34 integrally joining the head portion to first arm 18. Stub portion 34 is of a reduced diameter relative to head portion 32 and thereby forms an annular, circumferential groove 36 immediately adjacent free end 24 of arm 18. A button, including a head portion 38 and a reduced diameter stub portion 40, is integrally molded with and protrudes rearwardly of second arm 20. Again, reduced diameter stub portion 40 defines an annular, circumferential groove 42 immediately adjacent the free end of arm 20.

Figure 3:
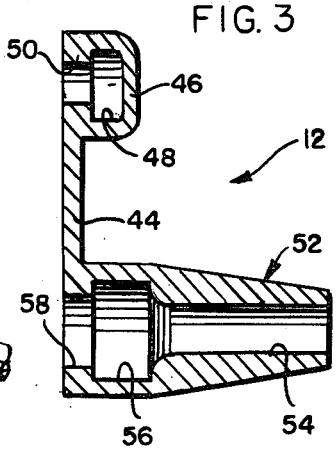
FIG. 3 is a horizontal, fragmented sectional view of the anti-tangle device shown in FIG. 1.

Referring to FIG. 3, anti-tangle device 12 includes an elongated flexible portion 44 in the form of a flexible strap. Complementary engaging means is integrally molded with opposite ends of strap 44 for releasably locking the anti-tangle device onto the free ends of arms 18 and 20. More particularly, a cap 46 is formed on one end of strap 44 and has an interior T-shaped cavity 48 to snap-fit over button 38, 40 on the free end of arm 20. The T-shaped cavity defines an interior flange 50 which seats within groove 42 adjacent the free end of arm 20. The cap completely encloses the button on the end of arm 20 to preclude any foreign matter from accumulating therearound.

The complementary engaging means on the opposite end of strap 44 for releasably locking onto the boss 32, 34 at the free end of arm 18 comprises a boot, generally designated 52. The boot is elongated generally perpendicular to and integral with strap 44. The boot has an axial passageway 54 extending therethrough for receiving lead wire 22. An enlarged interior cavity portion 56 receives head portion 32 at the free end of arm 18. An interior flange 58 seats within annular groove 36 about stub portion 34 at the free end of arm 18. Thus, boot 52 can be snap-fit over the complementary engaging means 32, 34 at the free end of arm 18 to releasably lock anti-tangle device 12 thereto.

Figure 4:
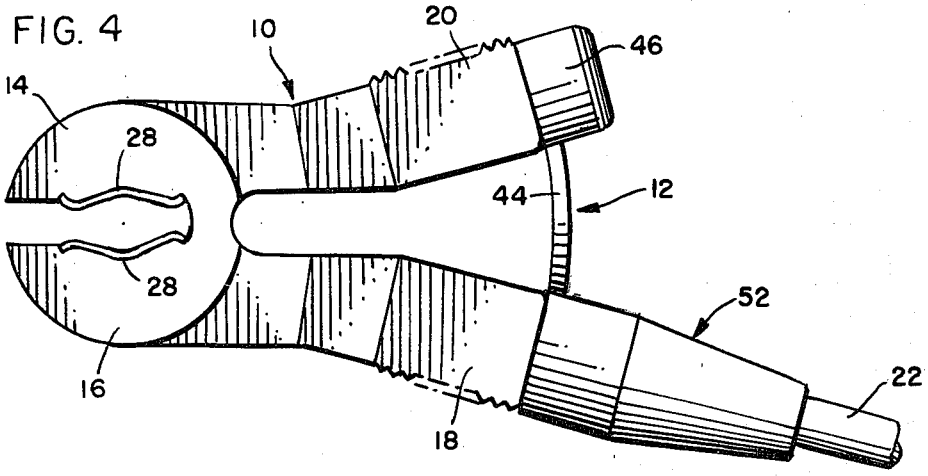
FIG. 4 is a top plan view of the terminal clip and anti-tangle device shown in FIG. 1.

Referring to FIG. 4, it can be seen that anti-tangle device 12 is releasably locked to the free ends of arms 18 and 20, with flexible strap 44 extending therebetween to prevent entanglement of the terminal clip and lead wire with other terminal clips or lead wires which otherwise would tend to become tangled and snag within the projections of the free ends of arms 18, 20. The flexible strap is of sufficient length to permit operative toward and away movement of the terminal clip arms. Boot 52 is elongated and surrounds lead wire 22 to provide bend relief means therefor. This is important because the lead wire is securely embedded within arm 18 of the terminal clip. Without the bend relief boot, the lead wire would tend to break due to repeated flexing at the free end of arm 18.

While a particular embodiment of the invention has been shown and described, it will be obvious to those skilled in the art that changes and modifications may be made therein without departing from the invention in its broader aspects, and therefore, the object of the appended claims is to cover all such changes and modifications which fall within the true spirit and scope of the invention.

What is claimed is:

1. A medical terminal clip for use with instruments such as medical monitoring instruments, or the like, comprising:

a terminal body member having first and second generally side-by-side arms movable toward and away from each other for opening and closing the clip, said first arm having a lead wire extending from a free end thereof; and an anti-tangle device extending between the free ends of said arms and of sufficient length to permit said toward and away movement of the arms, including complementary engaging means between the free ends of said arms and the anti-tangle device to releasably lock the device to the arms.

2. The medical terminal clip of claim 1 wherein said complementary engaging means on the free end of said second arm comprises a button and said complementary engaging means on said anti-tangle device includes a cap snap-fit over said button.

3. The medical terminal clip of claim 1 wherein said anti-tangle device includes flexible means extending between said complementary engaging means thereof to accommodate said toward and away movement of the arms.

4. The medical terminal clip of claim 3 wherein said flexible means and said complementary engaging means of said anti-tangle device comprise an integrally molded structure.

5. The medical terminal clip of claim 1 wherein said complementary engaging means on said anti-tangle device for locking onto the free end of said first arm comprises a boot embracing a portion of said lead wire.

6. The medical terminal clip of claim 5 wherein said boot is enlongated and surrounds said portion of the lead wire adjacent the free end of said first arm to provide bend relief means for the lead wire.

7. An anti-tangle device for use with an electrical connector having electrical contact means for engaging an electrode, said electrical connector having first and second generally side-by-side arms movable toward and away from each other for opening and closing the connector, each arm having one end fixed to said electrical contact means, and said first arm having a lead wire extending from the free end thereof, said anti-tangle device comprising:

a portion extending between the free ends of said arms and of sufficient length to permit said toward and away movement of the arms, and complementary engaging means between the free ends of said arms and opposite ends of said portion to releasably lock the device to the arms.

8. The anti-tangle device of claim 7 wherein said portion extending between the free ends of said arms is flexible to accommodate said toward and away movement of the arms.

9. The anti-tangle device of claim 8 wherein said portion and said complementary engaging means on opposite ends thereof comprise an integrally molded structure.

10. The anti-tangle device of claim 7 wherein said complementary engaging means on one opposite end of said portion for locking onto the free end of said first arm comprises a boot embracing said lead wire.

11. The anti-tangle device of claim 10 wherein said boot is elongated and surrounds the lead wire adjacent the free end of said first arm to provide bend relief means for the lead wire.

* * * * *